US011773728B2

(12) United States Patent
Barker et al.

(10) Patent No.: US 11,773,728 B2
(45) Date of Patent: Oct. 3, 2023

(54) PURGE ARRANGEMENT FOR DUAL-FEED AIRFOIL

(71) Applicant: Rolls-Royce Corporation, Indianapolis, IN (US)

(72) Inventors: Brett Barker, Indianapolis, IN (US); Eric Koenig, Indianapolis, IN (US)

(73) Assignee: ROLLS-ROYCE CORPORATION, Indianapolis, IN (US)

( * ) Notice: Subject to any disclaimer, the term of this patent is extended or adjusted under 35 U.S.C. 154(b) by 0 days.

(21) Appl. No.: 17/538,730

(22) Filed: Nov. 30, 2021

(65) Prior Publication Data

US 2023/0167743 A1 Jun. 1, 2023

(51) Int. Cl.

| | |
|---|---|
| ***F01D 5/18*** | (2006.01) |
| ***F01D 5/14*** | (2006.01) |
| ***F01D 9/04*** | (2006.01) |
| ***F01D 25/12*** | (2006.01) |

(52) U.S. Cl.

CPC ..... *F01D 5/186* (2013.01); *F01D 5/147* (2013.01); *F01D 9/041* (2013.01); *F01D 25/12* (2013.01); *F05D 2220/32* (2013.01); *F05D 2240/12* (2013.01); *F05D 2240/30* (2013.01); *F05D 2260/202* (2013.01)

(58) Field of Classification Search

CPC ..... F01D 5/187; F01D 5/147; F01D 5/186; F01D 5/189; F01D 25/12; F01D 9/041; F01D 5/143; F01D 9/065; F01D 5/188; F01D 5/081; F01D 25/08; F01D 9/02; F01D 5/14; F05D 2240/81; F05D 2260/201; F05D 2260/202; F05D 2260/2212; F05D 2260/22141; F05D 2220/32; F05D 2240/126; F05D 2260/204; F05D 2240/30; F05D 2240/301; F05D 2240/80; F05D 2250/185; F05D 2250/184; F05D 2250/183; F05D 2250/324; F05D 2260/20; F05D 2240/122; F05D 2240/12; F05D 2250/71; F05D 2240/304; F05D 2260/205; F05D 2260/2214; F05B 2240/801

See application file for complete search history.

(56) References Cited

U.S. PATENT DOCUMENTS

| | | | | |
|---|---|---|---|---|
| 6,213,714 | B1 | 4/2001 | Rhodes | |
| 6,264,428 | B1 | 7/2001 | Dailey et al. | |
| 6,554,563 | B2 * | 4/2003 | Noe | F01D 5/189 415/115 |

(Continued)

*Primary Examiner* — Eric J Zamora Alvarez

(74) *Attorney, Agent, or Firm* — Crowell & Moring LLP

(57) ABSTRACT

An airfoil, such as a vane or a blade for a gas turbine engine, may be provided. The airfoil may include a platform; a spar; a fillet; and a coversheet. The spar may include a passageway inside of the spar for a cooling fluid, a pedestal on an outer surface of the spar, and a spar hole configured to direct the cooling fluid from the passageway to the outer surface of the spar. The fillet may be located at the intersection of the platform and the spar, and may couple the spar to the platform. The fillet and/or the coversheet may include a protrusion extending along the edge of the coversheet. The protrusion, along with the pedestal and the outer surface of the spar, may define a purge groove. The purge groove and a purge groove outlet may form a cooling path for cooling fluid to flow onto the platform.

18 Claims, 6 Drawing Sheets

(56) References Cited

U.S. PATENT DOCUMENTS

| | | | | |
|---|---|---|---|---|
| 7,841,828 | B2 * | 11/2010 | Liang | F01D 5/143<br>416/193 A |
| 10,196,904 | B2 | 2/2019 | Heffernan et al. | |
| 10,329,924 | B2 | 6/2019 | Barker et al. | |
| 10,450,873 | B2 | 10/2019 | Barker et al. | |
| 10,626,731 | B2 | 4/2020 | Barker et al. | |
| 10,648,341 | B2 | 5/2020 | Barker et al. | |
| 10,774,657 | B2 * | 9/2020 | Spangler | F01D 9/065 |
| 2017/0211395 | A1 * | 7/2017 | Heffernan | F01D 5/187 |

* cited by examiner

PURGE ARRANGEMENT FOR DUAL-FEED AIRFOIL

TECHNICAL FIELD

The present disclosure relates generally to gas turbine engines and more specifically to airfoils used in gas turbine engines.

BACKGROUND

Present approaches to cooling an airfoil used in high temperature environments suffer from a variety of drawbacks, limitations, and disadvantages. There is a need for the inventive cooling components, apparatuses, systems and methods disclosed herein.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Figure 1:
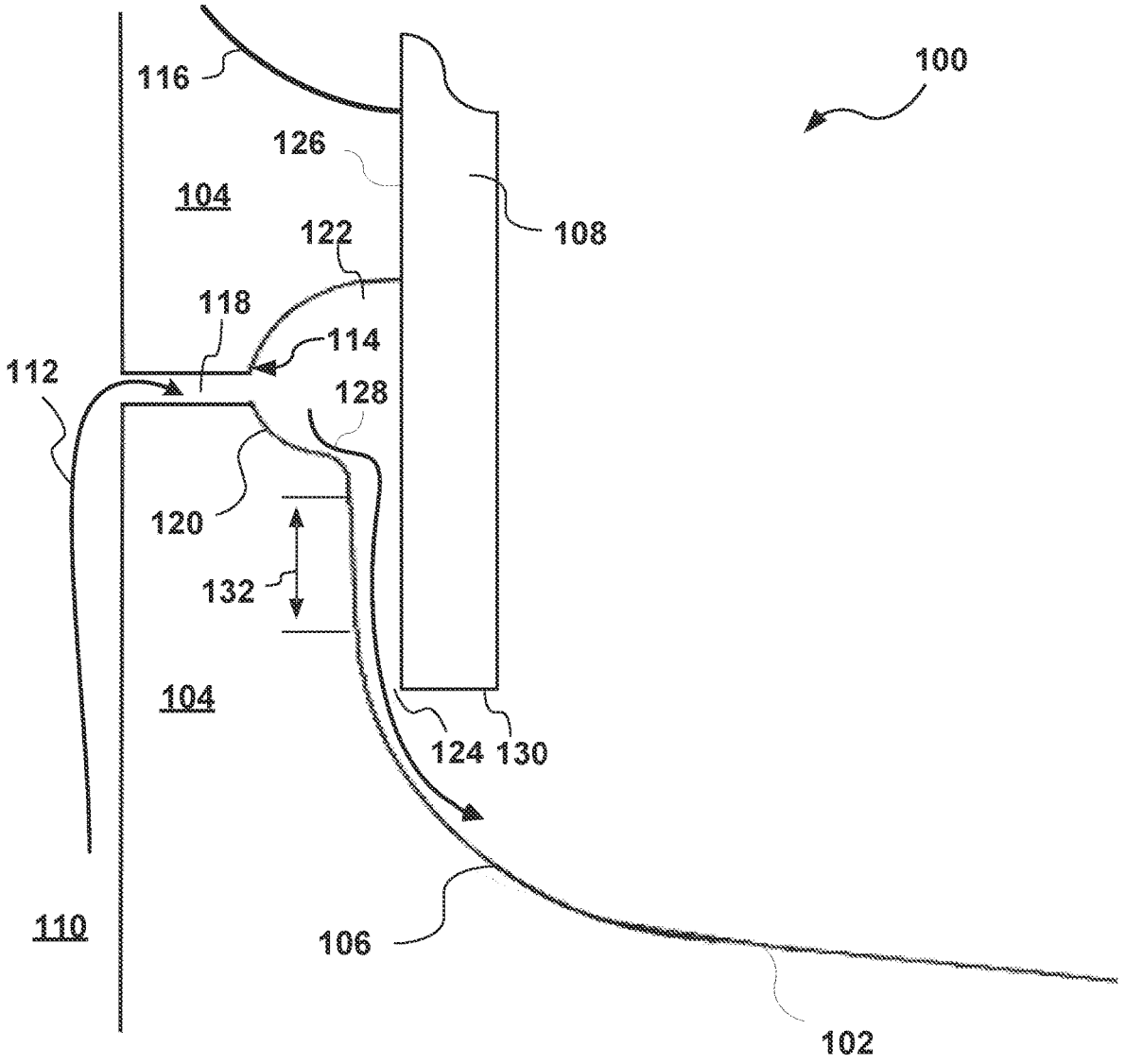
FIG. 1 illustrates a cross-sectional view of an example of an airfoil showing a purge groove, a platform, a spar, a fillet, and a coversheet.

An airfoil, such as a vane or a blade for a gas turbine engine, may be provided, where the airfoil comprises: a platform; a spar extending radially from the platform; a fillet; and a coversheet. The spar comprises a passageway inside of the spar for a cooling fluid, a pedestal on an outer surface of the spar, and a spar hole configured to direct the cooling fluid from the passageway to the outer surface of the spar. The pedestal may include one or more raised portions of any shape, for example, an elongated portion serving as a dam. The fillet is located at an intersection of the platform and the spar. An inner surface of the coversheet is positioned on the pedestal of the spar, where an edge of the coversheet is positioned adjacent to the fillet. The fillet and/or the coversheet includes a protrusion extending along, and adjacent to, the edge of the coversheet, where the pedestal, the outer surface of the spar, and the protrusion define a purge groove. For example, the protrusion may project away from the fillet and/or the coversheet that includes the protrusion. The protrusion together with the fillet and/or the inner surface of the coversheet, along the edge of the coversheet, define a purge groove outlet that opens toward the platform, where the purge groove and the purge groove outlet form a cooling path for the cooling fluid to flow onto the platform.

One interesting feature of the systems and methods described below may be that effective cooling on the airfoil is preserved, in particular, cooling of the fillet is preserved while also limiting the difference in pressure needed between the cooling fluid entering the passageway inside the spar and the cooling fluid exiting the purge groove outlet and any film holes. The protrusion along with the edge of the coversheet may form a transitional structure between the coversheet in order to add a more controllable gap for purged cooling fluid. Alternatively, or in addition, the coversheet may extend as close to the platform and/or fillet as possible to form a relatively tight gap. For example, airfoil cooling passages may discharge the cooling fluid into the purge groove and effectively purge the cooling fluid out through the relatively tight gap and onto the platform.

Another interesting feature of the systems and methods described below may be that the protrusion on the coversheet may maintain the relatively tight gap despite movement of the coversheet to deliver a more consistent leakage of cooling fluid. Alternatively, or in addition, sealing effectiveness may be improved with the addition of multiple protrusions on the fillet and the coversheet which may overlap to form a series of gaps (for example, a labyrinth seal) with better sealing effectiveness.

Another interesting feature of the systems and methods described below may be may be that a radius of curvature of an arc of the fillet is large enough that movement, particularly in a radial direction, of the coversheet relative to the spar during assembly does not substantially affect the size of the purge groove outlet. For example, such a radius of curvature of the arc of the fillet may reduce the need for a high purge flow to handle variation because the reduced movement of coversheet may limit the gap. For example, an arc of the fillet having a relatively high radius of curvature may increase manufacturing tolerances due to a flatter portion on the top of the curve of the fillet.

Figure 5:
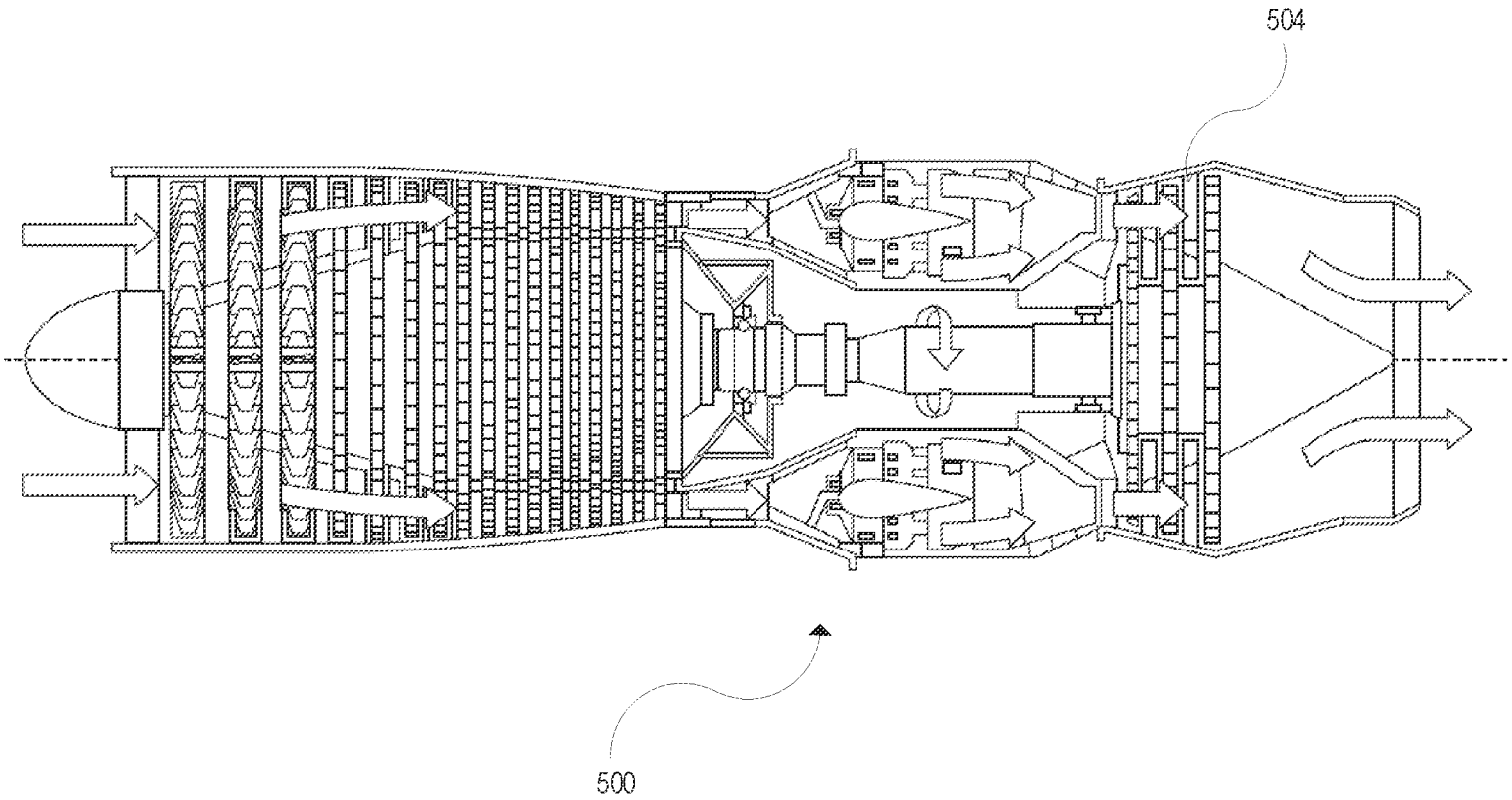
FIG. 5 is a cross-sectional view of a gas turbine engine that includes the airfoil.
Figure 6:
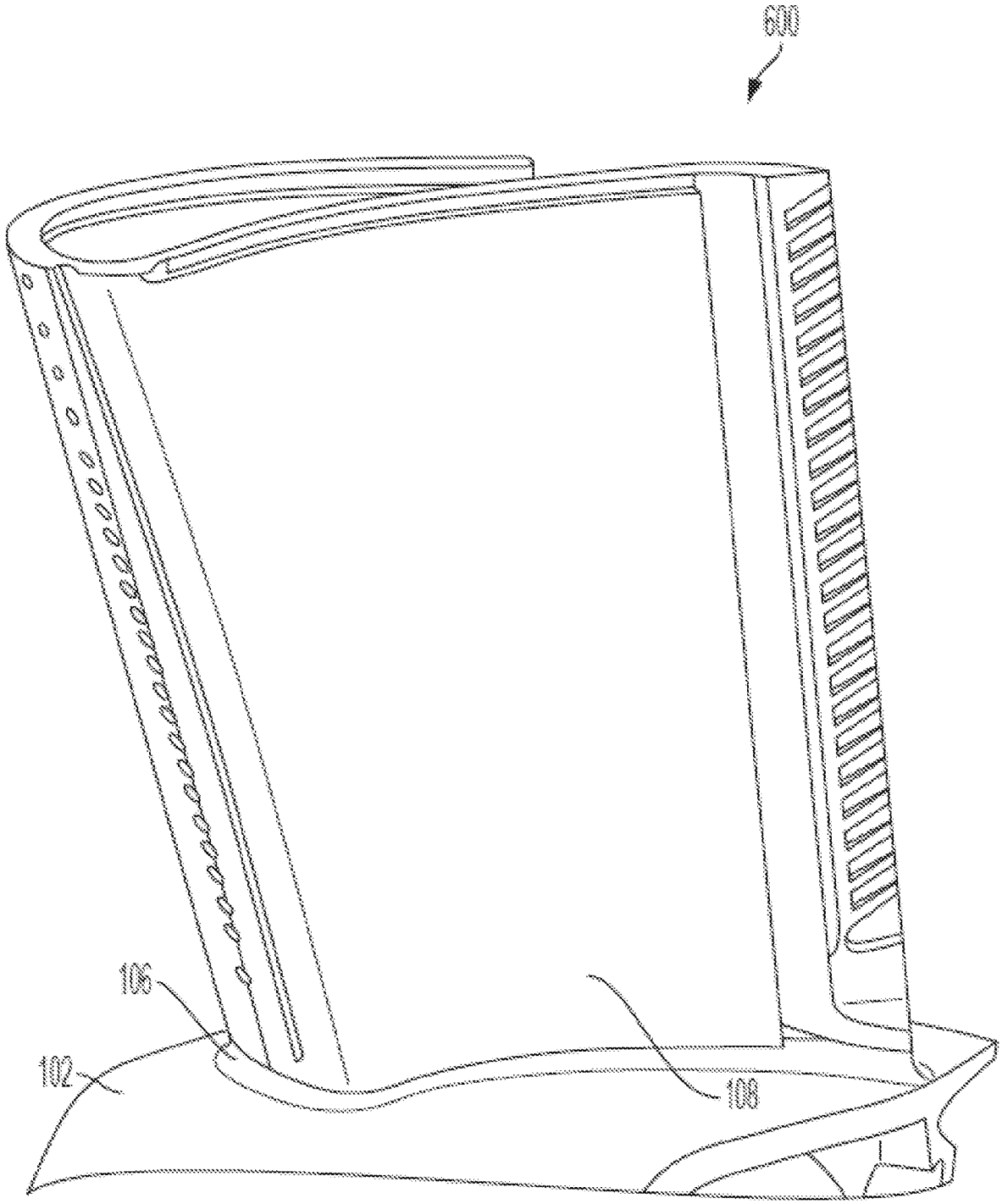
FIG. 6 is a perspective view of a turbine blade.

FIG. 1 illustrates an example of a cross-sectional view of an outer portion of an airfoil 100 for a gas turbine engine. The gas turbine engine may be any gas turbine engine, such as, for example, a gas turbine engine 500, shown in FIG. 5. The airfoil 100 may be, for example, a turbine blade 600, such as the turbine blade 600 shown in FIG. 6. The turbine blade 600 may be in a turbine section 504 of the gas turbine engine 500.

The airfoil 100 shown in FIG. 1 includes a platform 102, a spar 104, a fillet 106, and a coversheet 108. The spar 104 in the illustrated example may include a passageway 110 inside of the spar 104 for a cooling fluid 112, an outer surface 114 of the spar 104, a pedestal 116, and a spar hole 118. The fillet 106 includes a protrusion 120. The protrusion 120 may include a purge groove 122 and a purge groove outlet 124.

The platform 102 may extend outwardly from a base of the spar 104. The platform 102 may be positioned at various locations inside of a gas turbine engine. For example, the platform 102 may be located between the combustion chamber and the exhaust portion of a gas turbine engine. Alternatively, or in addition, the platform 102 may be coupled to a rotor assembly and an end wall coupled to a static portion of a turbine section in the gas turbine engine. In one example, the platform 102 may be configured to receive an attachment stalk (not shown) of the spar 104. Alternatively, the spar 104 and the platform 102 may be manufactured as a single unitary structure. Alternatively, or in addition, the platform 102 may include flow channels (not shown) coupled to a cooling fluid source. For example, the flow channels of the platform 102 may be fluidly coupled to the passageway 110 of the spar 104 so that cooling fluid may flow from a cooling fluid source into the passageway 110 of the spar 104.

The spar 104 may be a structural member of the airfoil 100 that provides mechanical support to the airfoil 100. The spar 104 may define the general shape and contours of the airfoil 100. The spar 104 may be a unitary structure or a combination of individual members. For example, the spar 104 may be a series of cross sections of a predefined width joined together. As another example, the spar 104 may be a combination of sections, such as a suction side and a pressure side joined together during manufacturing. Additionally, the spar 104 may include support members (not shown). The support members may add support to the spar 104 and/or define flow paths inside of the spar 104. For example, the spar 104 may have multiple support members that strengthen the spar 104 and define a series of flow channels and serpentine flow channels connected together within the spar 104. Alternatively, or in addition, the spar 104 may be a hollow shell with the passageway 110 inside of the shell, which is fed with the cooling fluid 112 such as air or any other suitable fluid. The spar 104 may be constructed of metal, metal alloy, ceramic matrix composite, or any other type of suitable material.

The fillet 106 may be a region along an intersection of the spar 104 and the platform 102.

Figure 2A:
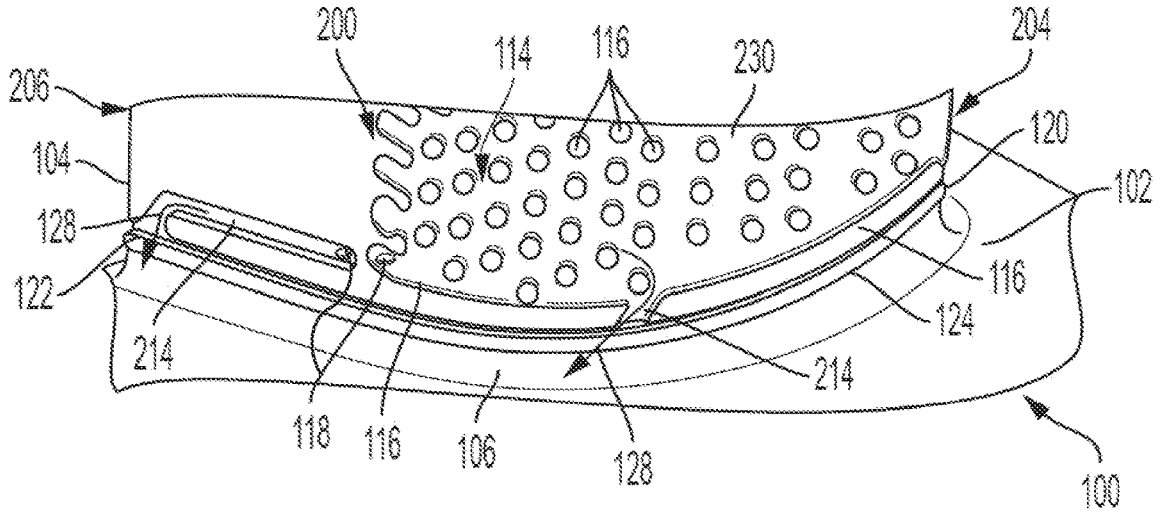
FIG. 2A illustrates a perspective view of a portion of a suction side of an example of an airfoil.
Figure 2B:
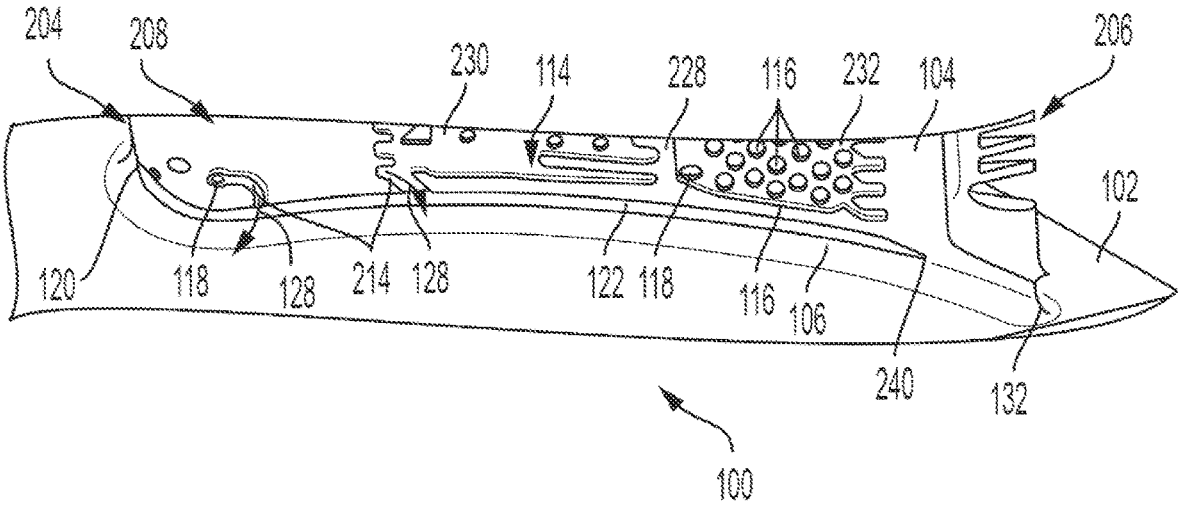
FIG. 2B illustrates a perspective view of a portion of a pressure side of an example of an airfoil.

The coversheet 108 may be a wall or a sheet on an outer portion of the airfoil 100. For example, the coversheet 108 may be a sheet coupled to, and/or mounted on, one or more raised portions such as pedestals 116 on the outer surface 114 of the spar 104. Note that FIG. 1 shows a cross section of a single one of the pedestals 116, but FIGS. 2A and 2B show an arrangement of the pedestals 116. An inner surface 126 of the coversheet 108 is coupled to, and/or mounted on the pedestals 116. In some examples, the coversheet 108 may wrap around the spar 104. The inner surface 126 of the coversheet 108 may be coupled to the pedestals 116 (for example, attached or bonded to) so as to define one or more cooling paths 128 between the inner surface 126 of the coversheet 108 and the outer surface 114 of the spar 104.

The spar 104 may comprise the passageway 110 for the cooling fluid 112 and the spar hole 118 configured to direct the cooling fluid 112 from the passageway 110 to the outer surface 114 of the spar 104. The passageway 110 may be a single passageway or a combination of multiple passageways. Examples of the passageway 110 include a single cavity located within the spar 104, main cooling channels connected with serpentine cooling channels, and/or other combinations of passageways that are shaped, oriented, and sized to fit the cooling requirements and/or other design considerations of the airfoil 100. In one example, the passageway 110 may extend through an internal portion of the attachment stalk (not shown) that penetrates the platform 102 of the spar 104. The passageway 110 may be in fluid communication with a cooling fluid source. For example, the passageway 110 may be connected with another passageway inside of the platform 102, and the cooling fluid 112 originating in a compression chamber of a gas turbine engine may pass through the passageway in the platform 102, through the passageway 110 of the spar 104, and through the spar hole 118 onto the outer surface 114 of the spar 104.

The cooling fluid 112 may be any compressible gaseous or non-gaseous fluid. Examples of the cooling fluid 112 may include air, compressed air, cooling air, and cooled cooling air. The cooling fluid 112 may be augmented for improved cooling, flow, and other design considerations. The cooling fluid 112 may be pressurized in a compressor, for example, and transferred to the passageway 110 of the spar 104. A differential pressure of the cooling fluid 112 between the passageway 110 and an exterior of the airfoil 100 may cause the cooling fluid 112 to flow through the spar hole 118, along the cooling path 128, through the purge groove outlet 124, and onto the platform 102 of the spar 104.

The spar 104 in the illustrated example may include the outer surface 114 that extends radially from the fillet 106. The cooling fluid 112 may be directed by the spar hole 118 from the passageway 110 to the outer surface 114 of the spar 104. The outer surface 114 of the spar 104 may contain one or more of the pedestals 116. The outer surface 114 of the spar 104, the inner surface 126 of the coversheet 108, and one or more of the pedestals 116 may together define the cooling path 128.

Each of the pedestals 116 may be a raised portion on the outer surface 114 of the spar 104. Any one or more of the pedestals 116 may be configured to partially define the cooling path 128 along the outer surface 114 of the spar 104. The size, number, spacing, and shape of the pedestals 116 may vary across the outer surface 114 of the spar 104. In some examples, one or more of the pedestals 116 may be elongated and/or include a dam. Alternatively, or in addition, one or more of the pedestals 116 may be in the shape of a rib. Any of the pedestals 116 may be formed of any material to transfer heat and/or to provide structural support for the coversheet 108. For example, the pedestals 116 may be formed of a conductive material and the cooling fluid may transfer heat away from the pedestals 116. Alternatively, or in addition, the pedestals 116 may transfer heat to the cooling fluid. The pedestals 116 may be coupled to the outer surface 114 of the spar 104 and/or the inner surface 126 of the coversheet 108. For example, the pedestals 116 may be bonded with the inner surface 126 of the coversheet 108. Additionally, or alternatively, the pedestals 116 may be conductively coupled to the outer surface 114 of the spar 104 so as to transfer heat to the spar 104. Alternatively, or in addition, the pedestals 116 may be conductively coupled to the inner surface 126 of the coversheet 108 to transfer heat away from the coversheet 108.

The spar hole 118 or multiple spar holes 118 may be located on and/or open to the outer surface 114 of the spar 104. The spar hole 118 may be any hole that leads from the passageway 110 inside of the spar 104 to the outer surface 114 of the spar 104.

The protrusion 120 may be included in the fillet 106 and/or the inner surface 126 of the coversheet 108 and configured to extend along, and adjacent to, the edge 130 of the coversheet 108 facing the platform 102. The edge 130 of the coversheet 108 facing the platform 102 may also be referred to a "lower edge" herein. The protrusion 120 may be any projection that extends outward from the outer surface 114 of the spar 104 if the protrusion 120 is included in the fillet 106. Alternatively, the protrusion 120 may be any projection that extends outward from the inner surface 126 of the coversheet 108 if the protrusion 120 is included in the coversheet 108. The protrusion 120 may have any shape. For example, the protrusion 120 may be in the shape of a rib or have any other elongated shape. An elongated shape may be any shape that has a longer length than width. The protrusion 120 may be made of any suitable material. The protrusion 120 may be integral to the spar 104 or the coversheet 108 depending on whether the protrusion 120 is included in fillet 106 or the coversheet 108. Alternatively, the protrusion 120 may be added to or coupled to the fillet 106 or the coversheet 108 depending on whether the protrusion 120 is included in fillet 106 or the coversheet 108.

The protrusion may effectively add a more controllable interface for the coversheet 108. For example, the protrusion 120 may include a straight section 132 in connection with the fillet 106. The straight section 132 may run approximately parallel to the wall of the coversheet 108 where the straight section 132 has a predetermined length that is in the range from, for example, 0.005 to 0.020 inches. Such a configuration enables a radial position the coversheet 108 to vary as needed during assembly of the airfoil 100 without the edge 130 of the coversheet 108 touching the fillet 106 and yet still maintaining a substantially constant gap between the coversheet 108 and the straight section 132.

In some examples, the protrusions 120 may be added to and/or included in the fillet 106, the inner surface 126 of the coversheet 108 and/or the outer surface 114 of the spar 104 and overlap each other to define a labyrinth seal or a knife seal. For example, the protrusions 120 included on the inner surface 126 of the coversheet 108 may be configured to mesh with the protrusions 120 on the outer surface 114 of the spar 104 and/or the fillet 106 thereby forming a serpentine flow path in the radial direction that is included in the cooling path 128. (See, for example, FIG. 4).

The purge groove 122 may include any groove in the outer surface 114 of the spar 104 having a first side defined by the protrusion 120 and a second side defined by the pedestal 116. The distance between the coversheet 108 and a bottom of the purge groove 122 may be about 0.020 inches. The term "about" as used herein with a value means within a tolerance of 25 percent of the value. For example, about 0.020 inches means 0.020 inches plus or minus 0.005 inches. In other examples, the distance between the coversheet 108 and the bottom of the purge groove 122 may be in a range from 0.018 inches to 0.022 inches. In still other examples, the distance between the coversheet 108 and the bottom of the purge groove 122 may be in some other range.

The purge groove outlet 124 may be defined by the protrusion 120 and the inner surface 126 of the coversheet 108 along the lower edge 130 of the coversheet 108. Alternatively, if the protrusion 120 is included in the coversheet 108, the purge groove outlet 124 may be defined by the protrusion 120 and a portion of the fillet 106 that is adjacent to the protrusion 120. In any case, the purge groove outlet 124 is configured to open toward the platform 102. The purge groove 122 and the purge groove outlet 124 define the cooling path 128 for the cooling fluid 112 to flow onto the platform 102. In one example, the purge groove outlet 124 may have a width that is in a range from 0.0002 to 0.020 inches. Alternatively, the purge groove outlet 124 may have a width that is in a range from 0.002 to 0.0015 inches. In still other examples, the purge groove outlet 124 may have a width in some other range.

The inner surface 126 of the coversheet 108 may be coupled to the pedestals 116 formed on the outer surface 114 of the spar 104 by any manufacturing technique known in the art. For example, the inner surface 126 of the coversheet 108 may be bonded to the pedestals 116 by a bonding process. Alternatively, or in addition, the coversheet 108 may be conductively coupled to the pedestals 116 so as to be able to transfer heat away from the coversheet 108 using the pedestals 116. The cooling path 128 may be defined in part by a portion of the coversheet 108. For example, the inner surface 126 of the coversheet 108, the outer surface 114 of the spar 104, and one or more of the pedestals 116 may together define the cooling path 128.

FIG. 2A illustrates a perspective view of a portion of a suction side 200 of the spar 104 and the platform 102 of the airfoil 100 without the coversheet 108 attached. The spar 104 includes the suction side 200, a leading edge 204, and a trailing edge 206. The coversheet 108, which is not shown in FIG. 2A, may be coupled to the suction side 200 of the spar 104. The suction side 200 of the spar 104 may include one or more of the spar holes 118 (not all of which are identified with a lead line in FIG. 2A), and the pedestals 116. The fillet 106 and the platform 102 are also shown in FIG. 2A. In the illustrated example, the fillet 106 includes the protrusion 120 in the shape of a rib. The purge groove 122 extends along, and immediately above, the protrusion 120. In particular, the purge groove 122 extends cord-wise along the edge 130 of the coversheet 108 (not shown in FIG. 2A).

The suction side 200 may extend from the leading edge 204 of the airfoil 100 to the trailing edge 206 of the airfoil 100. The lower edge 130 of the coversheet 108 (not shown) may extend adjacent to, and along, the fillet 106 from the leading edge 204 to the trailing edge 206. The inner surface 126 of the coversheet 108 (not shown) may be in contact with (for example, attached or bonded to) the pedestals 116.

The spar holes 118 may be configured to direct the cooling fluid 112 to the outer surface 114 of the suction side 200 of the spar 104. One or more of the spar holes 118 may be positioned adjacent the trailing edge 206 of the spar 104. Alternatively, or in addition, one or more of the spar holes 118 may be positioned adjacent the trailing edge 206 and be configured to direct the cooling fluid 112 to a cooling channel 214. For example, the spar hole 118 adjacent the trailing edge 206 may be configured to direct the cooling fluid 112 to the cooling channel 214, where the cooling channel 214 may direct the cooling fluid 112 to the purge groove 122.

Referring to FIG. 2A, the outer surface 114 of the spar 104 may include an arrangement of the pedestals 116. Any one or more of the pedestals 116 may be configured to partially define the cooling path 128 along the outer surface 114 of the spar 104. The size, number, spacing, and shape of the pedestals 116 may vary across the outer surface 114 of the spar 104. The inner surface 126 of the coversheet 108 (not shown), the pedestals 116, and the outer surface 114 of the suction side 200 of the spar 104 may define the cooling path 128 from the spar hole 118 to the purge groove outlet 124 (not shown) located at the edge of the coversheet 108 (not shown). Alternatively, or in addition, multiple spar holes 118 may direct the cooling fluid 112 to the outer surface 114 of the suction side 200 spar 104. The arrangement of the pedestals 116 on the outer surface 114 of the spar 104 may differ according to location.

In some examples, the outer surface 114 of the spar 104 may include multiple cooling paths 128 that, along with the arrangement of the pedestals 116, may define one or more cooling circuits 230, 232. Alternatively, or in addition, the pedestals 116 may be positioned adjacent to a radial dam 228 located on the outer surface 114 of the spar 104. The radial dam 228 may be in contact with (for example attached or bonded to) the inner surface 126 of the coversheet 108 (not shown). The radial dam 228 may separate a first cooling circuit 230 from a second cooling circuit 232 on the spar 104. In some examples, the cooling circuits 230, 232 may include the cooling channels 214 and/or one or more cooling paths 128.

FIG. 2B illustrates a perspective view of a portion of a pressure side 208 of the spar 104 and the platform 102 of the airfoil 100 without the coversheet 108 attached. The coversheet 108, which is not shown in FIG. 2B, may be coupled to the pressure side 208 of the spar 104. The pressure side 208 of the spar 104 may include one or more of the spar holes 118 (not all of which are identified with a lead line in FIG. 2B), and the pedestals 116 (not all of which are identified with a lead line in FIG. 2B). The fillet 106 and the platform 102 are also shown in FIG. 2B. In the illustrated example, the fillet 106 includes the protrusion 120 in the shape of a rib. The purge groove 122 extends along, and immediately above, the protrusion 120. In particular, the purge groove 122 extends cord-wise along the edge 130 of the coversheet 108 (not shown in FIG. 2B). In the illustrated example, the purge groove 122 and the protrusion 120 extend from the leading edge 204 of the spar 104 to a point 240 adjacent to the trailing edge 206 of the spar 104. However, the protrusion 120 and the purge groove 122 may extend cord-wise along one or more portions of the spar 104 that is(are) different than shown. Alternatively or in addition, the protrusion 120 may comprise multiple sections instead of the single, unbroken rib as shown in FIG. 2B. Alternatively or in addition, the purge groove 122 may span the cord-wise length of the spar 104 and terminate at the trailing edge 206 and/or the pressure side 208.

The pressure side 208 may extend from the leading edge 204 of the airfoil 100 to the trailing edge 206 of the airfoil 100. The lower edge 130 of the coversheet 108 (not shown) may extend adjacent to, and along, the fillet 106 from the leading edge 204 to the trailing edge 206. The inner surface 126 of the coversheet 108 (not shown) may be in contact with (for example, attached or bonded to) the pedestals 116.

The outer surface 114 of the pressure side 208 of the spar 104 may include an arrangement of the pedestals 116. Any one or more of the pedestals 116 may be configured to partially define the cooling path 128 along the outer surface 114 of the spar 104. The size, number, spacing, and shape of the pedestals 116 may vary across the outer surface 114 of the spar 104. The inner surface 126 of the coversheet 108 (not shown), the pedestals 116, and the outer surface 114 of the pressure side 208 of the spar 104 may define the cooling path 128 from the spar hole 118 to the purge groove outlet 124 (not shown) located at the edge of the coversheet 108 (not shown). Alternatively, or in addition, more than one of the cooling paths 128 may lead from the spar holes 118 to the purge groove 122 and, subsequently, to the purge groove outlet 124 (not shown). The arrangement of the pedestals 116 on the outer surface 114 of the spar 104 may differ according to location on the spar 104.

Alternatively, or in addition, a plurality of the spar holes 118 may be located adjacent the leading edge 204. In some examples, each of the spar holes 118 may be configured to direct the cooling fluid 112 to a respective one of the cooling channels 214, where each of the cooling channel 214 directs the cooling fluid 112 to the purge groove 122. Alternatively, or in addition, the spar holes 118 may be configured to feed the cooling fluid 112 to the cooling path 128 that passes through the cooling channel 214 and ultimately to the purge groove 122.

The pressure side 208 of the spar 104 may comprise one or more arrangements of the pedestals 116. The arrangement of pedestals 116 included on the outer surface 114 of the pressure side 208 may be the same as or different from the arrangements of pedestals 116 on the outer surface 114 of the suction side 200. The inner surface 126 of the coversheet 108 (not shown) may be in contact with the pedestals 116 included on the outer surface 114 of the pressure side 208 so as to define the one or more cooling circuits 230, 232, as discussed above in regard to the suction side 200.

In some examples, the radial dam 228 may separate the first cooling circuit 230 from the second cooling circuit 232. The cooling circuits 230, 232 may include one or more of the cooling channels 214 and/or one or more of the cooling paths 128. Alternatively, or in addition, the radial dam 228 may be positioned adjacent the leading edge 206.

Figure 3:
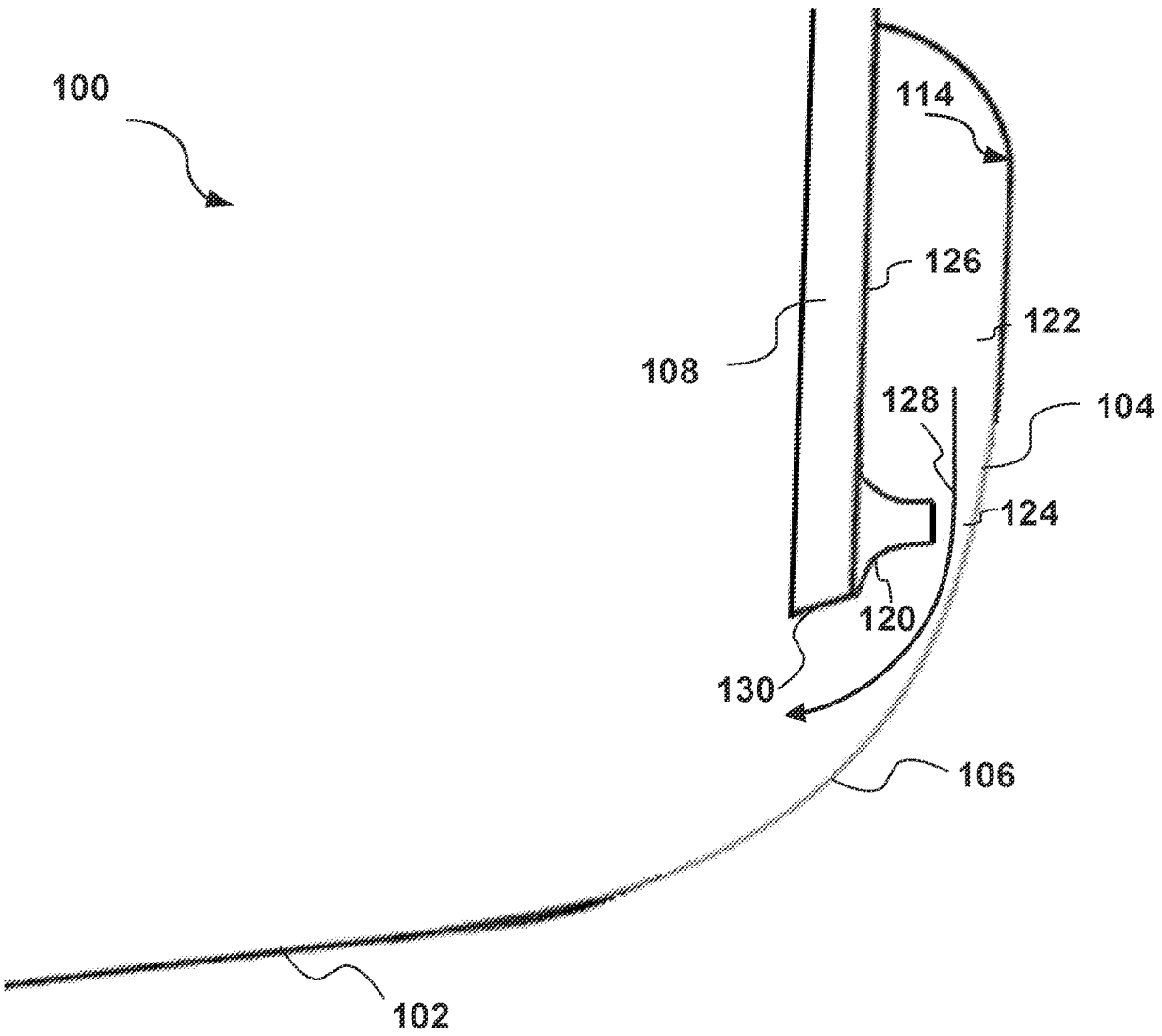
FIG. 3 is a cross-sectional view of an example of a coversheet including a protrusion that helps define a purge groove.

FIG. 3 illustrates a cross-sectional view of an example of the airfoil 100 where the coversheet 108 includes the protrusion 120 that helps define the purge groove 122. In the illustrated example, the fillet 106 is a conventionally shaped. In other examples, the radius of curvature of the arc of the fillet 106 may be higher than in conventionally shaped fillets. Alternatively, or in addition, the fillet 106 may also include a protrusion similar to the protrusion 120 shown in FIG. 1.

In the illustrated example, the protrusion 120 extends chord-wise along the edge 130 of the coversheet 108. The purge groove 122 extends along, and immediately above, the protrusion 120. The protrusion 120 included on the coversheet 108 may provide a relatively narrow gap for the purge groove outlet 124. As shown in FIG. 3, the cooling fluid may be directed on the cooling path 128 along the outer surface 114 of the spar 104 in the purge groove 122 and onto the platform 102 via the purge groove outlet 124.

Figure 4:
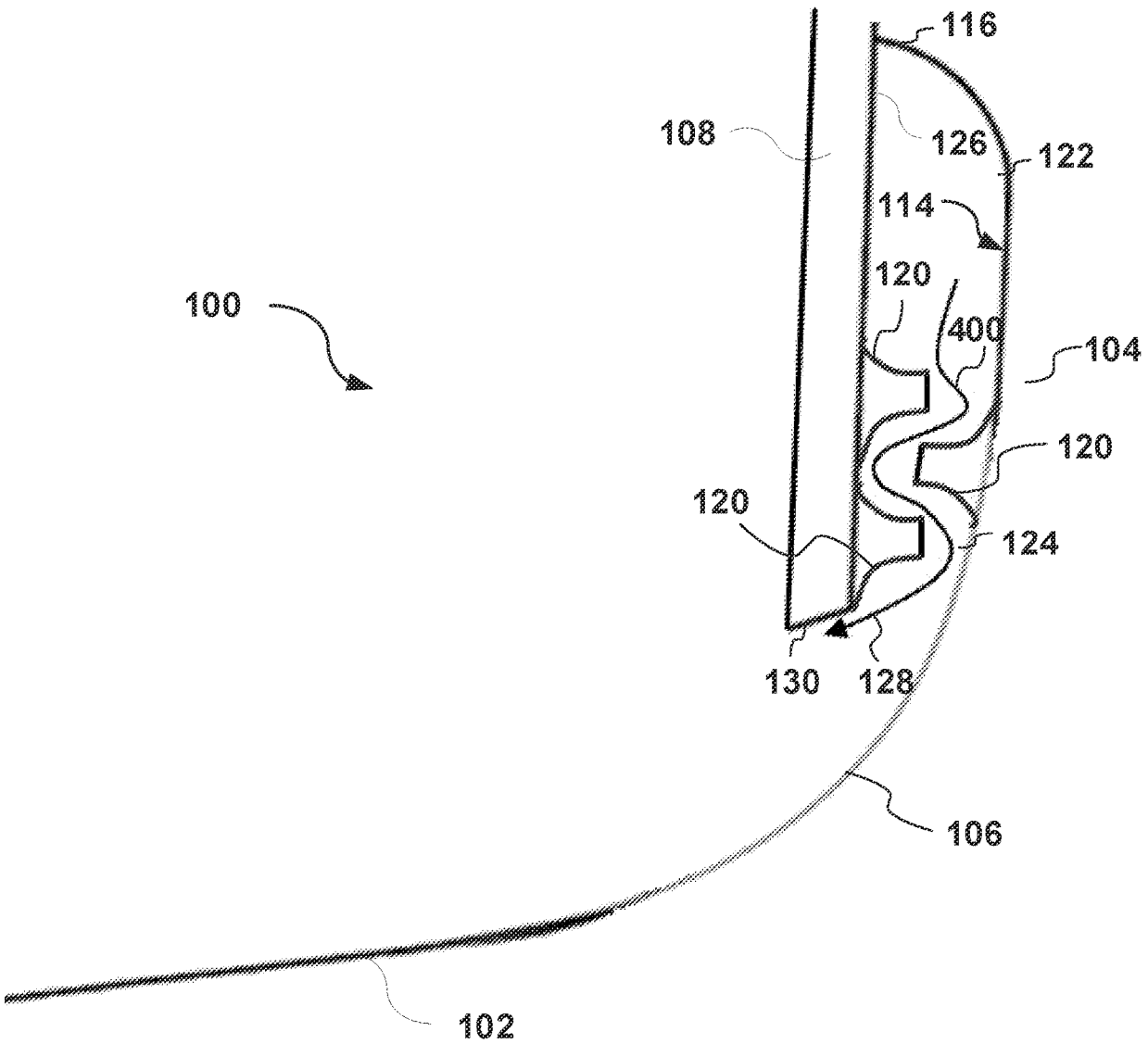
FIG. 4 is a cross-sectional view of an example of a serpentine cooling path arrangement of an airfoil.

FIG. 4 illustrates a cross-sectional view of an example of the protrusions 120 being located on the coversheet 108 and the fillet 106 to define a serpentine flow path 400 included in the cooling path 128. The protrusions 120 are included on the inner surface 126 of the coversheet 108 and the fillet 106. In other examples not illustrated here, one or more of the protrusions 120 are located on the outer surface 114 of the spar 104 above (in other words, radially outward of) the arch of the fillet 106. The protrusions 120 overlap to define the labyrinth seal or the knife seal. In other words, one or more of the protrusions 120 included on the inner surface 126 of the coversheet 108 mesh with one or more of the protrusions 120 on the outer surface 114 of the spar 104 and/or the fillet 106 as shown to define the serpentine flow path 400.

In the illustrated example, two of the protrusions 120 are located on the coversheet 108, and one of the protrusions 120 is located on the fillet 106. In an alternative example, only one of the protrusions 120 may be located on the coversheet 108 and two of the protrusions 120 may be located on the fillet 106 and/or on another portion of the outer surface 114 of the spar 104. In still other examples, the coversheet 108, the fillet 106, and/or another portion of the outer surface 114 of the spar 104 may each include two or more of the protrusions 120. The protrusions 120 adjacent the purge groove 122 may, together with the pedestal 116, and the coversheet 108, define the purge groove 122.

To clarify the use of and to hereby provide notice to the public, the phrases "at least one of <A>, <B>, . . . and <N>" or "at least one of <A>, <B>, . . . or <N>" or "at least one of <A>, <B>, <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

While various embodiments have been described, it will be apparent to those of ordinary skill in the art that many more embodiments and implementations are possible.

Accordingly, the embodiments described herein are examples, not the only possible embodiments and implementations.

Furthermore, the advantages described above are not necessarily the only advantages, and it is not necessarily expected that all of the described advantages will be achieved with every embodiment.

What is claimed is:

1. An airfoil for a gas turbine engine, the airfoil comprising:

a platform;

a spar extending radially from the platform, the spar comprising a passageway inside of the spar for a cooling fluid, a pedestal on an outer surface of the spar, and a spar hole configured to direct the cooling fluid from the passageway to the outer surface of the spar;

a fillet located at an intersection of the platform and the spar; and a coversheet, wherein an inner surface of the coversheet is positioned on the pedestal of the spar, wherein an edge of the coversheet is positioned adjacent to the fillet, wherein the fillet and/or the coversheet includes a protrusion extending along, and adjacent to, the edge of the coversheet, wherein the pedestal, the outer surface of the spar, and the protrusion define a purge groove, wherein the protrusion together with the fillet and/or the inner surface of the coversheet along the edge of the coversheet define a purge groove outlet that opens toward the platform, and wherein the purge groove and the purge groove outlet form a cooling path for the cooling fluid to flow onto the platform; and wherein the spar hole is positioned adjacent to a leading edge of the spar and is configured to direct the cooling fluid to a cooling channel, wherein the cooling channel directs the cooling fluid to the purge groove.

2. The airfoil of claim 1, wherein the purge groove extends from a first point located on a pressure side adjacent to a trailing edge of the airfoil to a second point located on a suction side of the airfoil adjacent to the trailing edge of the airfoil.

3. The airfoil of claim 1, wherein the protrusion extends from a first point on a pressure side adjacent to a trailing edge of the airfoil to a second point on the pressure side of the airfoil adjacent to a leading edge of the airfoil.

4. The airfoil of claim 1, wherein the spar and the coversheet include a plurality of protrusions that mesh to form a serpentine flow path, which is part of the cooling path, wherein the plurality of protrusions includes the protrusion.

5. The airfoil of claim 1, wherein a depth of the purge groove is about 0.020 inches.

6. The airfoil of claim 1, wherein the purge groove outlet has a width that is in a range from 0.0002 to 0.020 inches.

7. The airfoil of claim 1, wherein the purge groove outlet has a width that is in a range from 0.002 to 0.015 inches.

8. The airfoil of claim 1, wherein the purge groove outlet spans a distance between the edge of the coversheet and a curve of the fillet, wherein the distance is about 0.020 inches.

9. The airfoil of claim 1, wherein the outer surface of the spar and the inner surface of the coversheet form a labyrinth seal.

10. The airfoil of claim 1, wherein the protrusion includes a straight section that runs parallel with the coversheet having a predetermined length of about between 0.005 to 0.020 inches.

11. The airfoil of claim 1, wherein the cooling path is unobstructed from the spar hole to the purge groove outlet.

12. The airfoil of claim 1, wherein the airfoil is a blade or vane.

13. An airfoil for use in a gas turbine engine, the airfoil comprising:

a spar comprising a passageway inside of the airfoil for delivery of a cooling fluid and a spar hole, the spar hole leading from the passageway to an outer surface of the spar;

a platform at a base of the spar;

a fillet located at an intersection of the spar and the platform, wherein the fillet includes a protrusion; and a coversheet positioned on an arrangement of pedestals located on the outer surface of the spar, wherein an edge of the coversheet is adjacent to the fillet, and wherein an elongated pedestal, the outer surface of the spar, and the protrusion define a purge groove, wherein the purge groove is configured to receive the cooling fluid from the spar hole, wherein the purge groove extends chord-wise along the edge of the coversheet and directs the cooling fluid to a purge groove outlet, which also extends chord-wise along the edge of the coversheet and opens onto the platform; and wherein the purge groove and the purge groove outlet are located on a suction side of the airfoil and the purge groove extends to a trailing edge of the airfoil, wherein a cooling channel partially extends parallel to the purge groove, wherein the spar hole leads to the cooling channel and the cooling channel is configured to direct the cooling fluid from the spar hole to the purge groove.

14. The airfoil of claim 13, wherein a plurality of passageways on the outer surface of the spar are configured to direct the cooling fluid to the purge groove.

15. The airfoil of claim 13, wherein the spar includes a plurality of pedestals located between a plurality of spar holes and at least one passageway that leads to the purge groove.

16. The airfoil of claim 13, wherein the protrusion has a rib shape.

17. The airfoil of claim 13, wherein a plurality of spar holes are located adjacent a leading edge of the airfoil and are configured to supply the cooling fluid to the purge groove.

18. An airfoil for use in a gas turbine engine, the airfoil comprising:

a spar comprising a passageway inside of the airfoil for delivery of a cooling fluid and a spar hole, the spar hole leading from the passageway to an outer surface of the spar;

a platform at a base of the spar;

a fillet located at an intersection of the spar and the platform, wherein the fillet includes a protrusion; and a coversheet positioned on an arrangement of pedestals located on the outer surface of the spar, wherein an edge of the coversheet is adjacent to the fillet, and wherein an elongated pedestal, the outer surface of the spar, and the protrusion define a purge groove, wherein the purge groove is configured to receive the cooling fluid from the spar hole, wherein the purge groove extends chord-wise along the edge of the coversheet and directs the cooling fluid to a purge groove outlet, which also extends chord-wise along the edge of the coversheet and opens onto the platform; and wherein the purge groove and the purge groove outlet are located on a pressure side of the airfoil and the purge groove extends to a trailing edge of the airfoil, wherein a cooling channel partially extends parallel to the purge groove, wherein the spar hole leads to the cooling channel and the cooling channel is configured to direct the cooling fluid from the spar hole to the purge groove.

* * * * *